US005799881A

United States Patent [19]

Urata et al.

[11] Patent Number: 5,799,881

[45] Date of Patent: Sep. 1, 1998

[54] METHOD AND SYSTEM OF PRODUCING TONER

[75] Inventors: Yoshinori Urata, Kashihara; Takao Yoneda, Shiki-gun; Yoshiaki Akazawa, Nara; Yasuharu Morinishi, Tenri; Nobuhiko Nakano; Tadashi Nakamura, both of Nara; Takeaki Ouchi, Shiki-gun; Satoshi Ogawa, Yamatokoriyama, all of Japan

[73] Assignee: Sharp Kabushiki Kaisha, Osaka, Japan

[21] Appl. No.: 792,452

[22] Filed: Jan. 31, 1997

[30] Foreign Application Priority Data

Mar. 15, 1996 [JP] Japan ..... 8-059690

[51] Int. Cl.[6] ..... B02C 19/06

[52] U.S. Cl. ..... 241/5; 241/40; 241/78; 241/80

[58] Field of Search ..... 241/5, 39, 40, 241/29, 80, 97, 78

[56] References Cited

U.S. PATENT DOCUMENTS 4,784,333 11/1988 Hikake et al. ..... 241/5

5,358,183 10/1994 Kanda et al. ..... 241/5

5,435,496 7/1995 Kanda et al. ..... 241/5

FOREIGN PATENT DOCUMENTS 8-314191 11/1996 Japan .

*Primary Examiner*—Mark Rosenbaum

*Attorney, Agent, or Firm*—David C. Conlin; George W. Neuner

[57] ABSTRACT

A toner producing system which can efficiently produce toner having a sharp particle size distribution by suppressing the occurrence of microscopic powders and improve energy efficiency in pulverization. The system is furnished with a second pulverizing apparatus having a second colliding plate inclined at an angle in a range between 45° and 90° inclusive with respect to a direction in which a raw material subject to pulverization is introduced into a second pulverizing chamber through a second nozzle, and a third pulverizing apparatus having a third colliding plate with a conical member being placed thereon, so that the raw material introduced into a third pulverizing chamber through a third nozzle collides with an inner surface thereof following the collision with the third colliding plate.

11 Claims, 7 Drawing Sheets

METHOD AND SYSTEM OF PRODUCING TONER

FIELD OF THE INVENTION

The present invention relates to method and system of producing toner used for electrophotography and the like.

BACKGROUND OF THE INVENTION

A combination of a classifying apparatus and a pulverizing apparatus or a combination of two classifying apparatuses and a pulverizing apparatus is known as a pulverizing system for producing toner used for electrophotography and the like.

One type of the pulverizing system pulverizes a raw material mechanically, while another type of the pulverizing apparatus uses a jet mill as jet-type pulverizing means. In the latter type, a high-pressure air stream is released from a jet nozzle to trap material particles within the jet stream, so that the particles are pulverized by colliding one with another and the wall or other collision bodies. Both types use a combination of one pulverizing means defined as above and one or two classifying means to pulverize a toner raw material.

However, in the above conventional pulverizing method, besides the powders of the raw material pulverized to an adequate particle size, those having various particle sizes are produced during the pulverizing step and supplied to the classifying means, and such powders having various particle sizes are circulated between the pulverizing means and classifying means.

Accordingly, the resulting microscopic powders have a broad particle size distribution, and the system operates under a considerably large load. Thus, the classified pulverized product includes a large quantity of coarse particles that deteriorate the quality thereof.

On the other hand, accompanying the coarse powders returned from the classifying means to the pulverizing means, a significant quantity of microscopic powders, which need no further pulverization, are returned as well. As a result, these microscopic powders are pulverized unnecessarily, and the resulting pulverized product also includes excessive microscopic powders, thereby possibly producing agglomerates of the microscopic powders. The agglomerates are unwanted because they lower the yield of powders of a desired particle size in the following classifying step.

Thus, the conventional method produces a pulverized product including a significant quantity of the coarse powders and microscopic powders, and attains poor classification efficiency, thereby making it impossible to produce toner having a sharp particle size distribution. An image formed using toner produced in the above manner has a low density and considerable fogging, and therefore, can not render high quality.

In addition, poor classification efficiency reduces the energy efficiency in pulverization.

To solve the above problems, Japanese Examined Patent Publication Nos. 66033 and 66034 (Tokukouhei No. 6-66033 and 6-66034, respectively) disclose a technique to produce toner having a sharp particle size distribution. To be more specific, a first pulverizing means and a second pulverizing means are provided, and the former pulverizes the raw material with a major strength while the latter does so with a minor strength.

However, the technique of the above two publications can not solve the problem of overpulverization, because the air pressure for pulverization is higher in the first pulverizing means than the second pulverizing means. As a result, the microscopic powders are produced in such a significant quantity that the classification efficiency, and hence the energy efficiency in pulverization are lowered.

SUMMARY OF THE INVENTION

It is therefore an object of the present invention to provide method and system which can efficiently produce toner having a sharp particle size distribution and improve energy efficiency in pulverization by suppressing the occurrence of the microscopic powders.

The above object is fulfilled by a system of producing toner by pulverizing a solid toner raw material and classifying a resulting pulverized material, and the above system is furnished with:

- a first pulverizing apparatus for coarsely pulverizing the toner raw material to a first pulverized material;
- a first classifying apparatus for classifying the first pulverized material into a first classified coarse powders and a first classified pulverized material, the first classified pulverized material having a smaller particle size than the first coarse powders;
- a second pulverizing apparatus for introducing the first classified coarse powders to a second pulverizing chamber through a second nozzle, and pulverizing the first classified coarse powders to a second pulverized material by making the first classified coarse powder collide with a second colliding member provided in the second pulverizing chamber:
  - a first delivering member for delivering the first and second pulverized materials to the first classifying apparatus;
  - a second classifying apparatus for classifying the first classified pulverized material into a second classified coarse powders and a second classified pulverized material, the second classified pulverized material having a smaller particle size than the second classified coarse powders;
  - a third pulverizing apparatus for introducing the second classified coarse powders to a third pulverizing chamber through a third nozzle, and pulverizing the second classified coarse powders to a third pulverized material by making the second classified coarse powder collide with a third colliding member provided in the third pulverizing chamber: and
  - a second delivering member for delivering the first and third pulverized materials to the second classifying apparatus, wherein,

- the second colliding member includes a second colliding plate, the second colliding plate having a colliding surface inclined at an angle in a range between 45° and 90° inclusive with respect to a direction in which the first classified coarse powders are introduced into the second pulverizing chamber, and
- the third colliding member has a shape such that makes the second classified coarse powders collide with an inner surface of the third pulverizing chamber following collision with the third colliding member.

In the above toner producing system, the first pulverized material obtained by the first pulverizing apparatus is delivered to the first classifying apparatus by means of the first delivering member, and classified into the first classified coarse powders and first classified pulverized material. The first coarse powders are further pulverized to the second pulverized material by the second pulverizing apparatus, which is delivered again to the first classifying apparatus by means of the first delivering member and subject to classification.

On the other hand, the first classified pulverized material is delivered to the second classifying apparatus by means of the second delivering member, and classified into the second classified coarse powders and second classified pulverized material. The second classified coarse powders are further pulverized to the third pulverized material by the third pulverizing apparatus. Subsequently, the third pulverized material is again delivered to the second classifying apparatus by means of the second delivering member and subject to classification. The resulting second classified pulverized material is obtained as a final product, namely, toner.

The second colliding member has the second colliding plate, whose colliding surface is inclined at an angle in a range between 45° and 90° inclusive with respect to the direction in which the first classified coarse powders are introduced into the second pulverized chamber through the second nozzle. According to this arrangement, the first classified coarse powders are pulverized at the weakest possible impact force, so that the first classified coarse powders collides with the second colliding plate the least number of times, thereby suppressing the overpulverization, and hence the occurrence of microscopic powders.

Also, as has been explained, the second classified coarse powders which are not pulverized to a satisfactory particle size by the second pulverizing apparatus are further pulverized by the third pulverizing apparatus. In the third pulverizing apparatus, the second classified coarse powders collide with the inner surface of the third pulverizing chamber following the collision with the third colliding member. Therefore, the second classified coarse powders repetitively collide with the third colliding member or the inner surface of the third colliding chamber in a single pulverizing operation. This arrangement makes it possible to pulverize a small quantity of coarse powders with a major impact force.

Thus, the present toner producing system can enhance the classification efficiency by reducing a ratio of the coarse powders and microscopic powders in the final product. Thus, the present toner producing system can efficiently produce toner having a sharp particle size distribution by suppressing the occurrence of the microscopic powders. An image formed using the toner thus produced renders a high quality with a higher density and less fog. In addition, the present toner producing system can enhance the energy efficiency in pulverization.

The above object is also fulfilled by a method of producing a toner by pulverizing a solid toner raw material and classifying a resulting pulverized material, the method being composed of:

a first step of pulverizing the solid toner raw material to a first pulverized material;

a second step of classifying the first pulverized material into first classified coarse powders and a first classified pulverized material, the first classified pulverized material having a smaller particle size than the first coarse powders;

a third step of pulverizing the first classified coarse powders to a second pulverized material by giving a first impact force;

a fourth step of classifying a mixture of the first and second pulverized materials into the first classified coarse powders and first classified pulverized material;

a fifth step of classifying the first classified pulverized material into second classified coarse powders and a second classified pulverized material, the second classified pulverized material having a smaller particle size than the second coarse powders;

a sixth step of pulverizing the second classified coarse powders to a third pulverizing material by giving a second impact force, the second impact force being stronger than the first impact force; and a seventh step of classifying a mixture of the first classified pulverized material and third pulverized material into the second classified coarse powders and second classified pulverized material.

According to the above method, the second pulverized material is obtained with the weakest possible impact force to suppress the overpulverization, and hence the occurrence of microscopic powders. Also, the third pulverized material is obtained through repetitive collision of the second classified coarse powders in a single pulverizing operation. This makes it possible to pulverize a small quantity of coarse powders with a major impact force.

Thus, present toner producing method can enhance the classification efficiency by reducing a ratio of the coarse powders and microscopic powders in the material subject to classification, so that the same can efficiently produce toner having a sharp particle size distribution by suppressing the occurrence of the microscopic powders. An image formed using the toner thus produced renders high quality with a higher density and less fog. In addition, the system adopting the present toner producing method can enhance the energy efficiency in pulverization.

For a fuller understanding of the nature and advantages of the invention, reference should be made to the ensuing detailed description taken in conjunction with the accompanying drawings.

DESCRIPTION OF THE EMBODIMENTS (Embodiment 1)

The following description will describe an example embodiment of the present invention.

A toner producing system of the present embodiment produces toner in the following procedure:

(1) melt-kneading components including a binder resin and a coloring agent to produce a kneaded product;

(2) cooling and solidifying the kneaded product to make a solid toner raw material; and (3) pulverizing and classifying the toner raw material.

Figure 4:
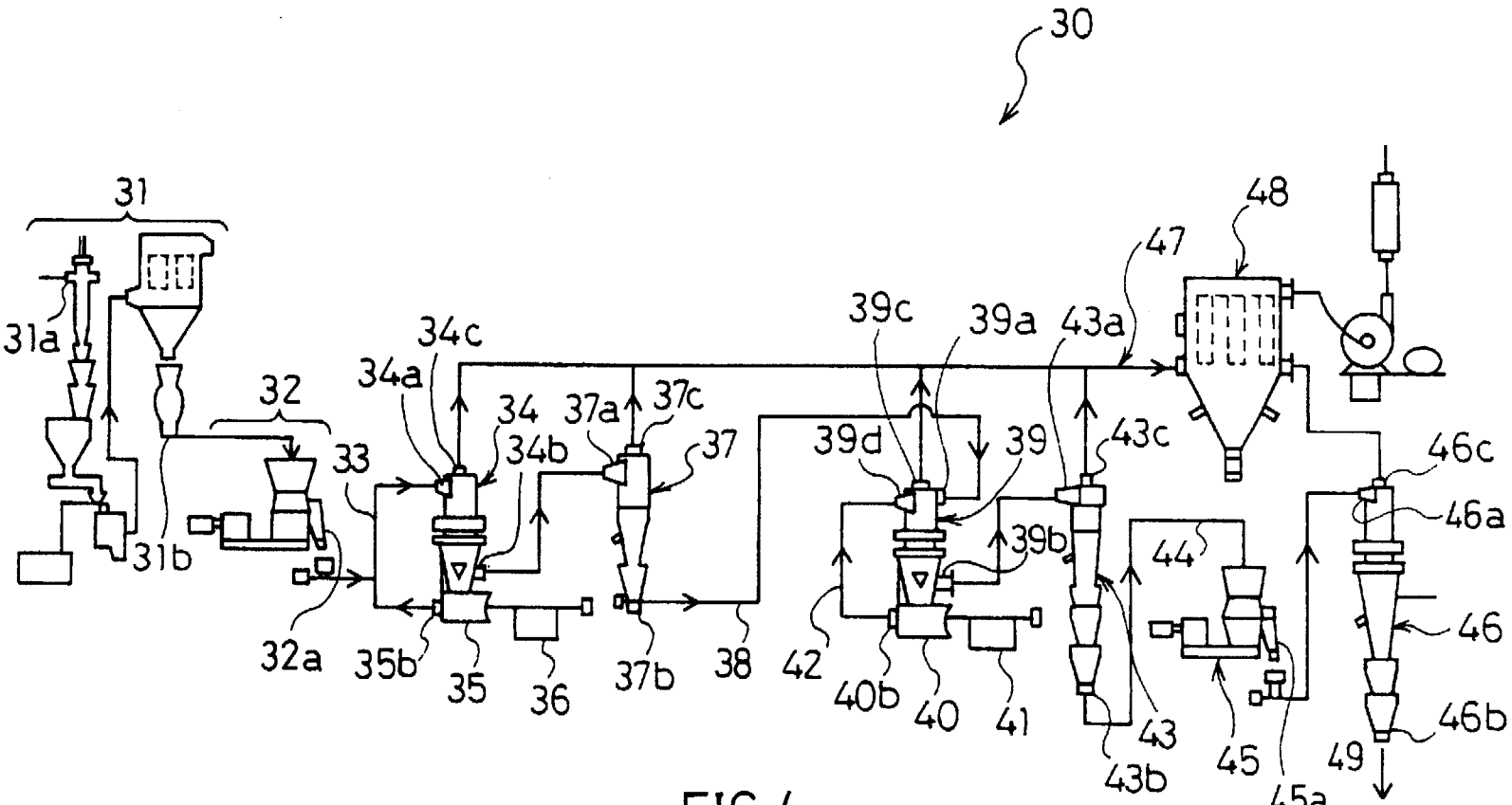
FIG. 4 is a view illustrating a schematic structure of the above toner producing system.

Thus, as shown in FIG. 4, a toner producing system 30 comprises three pulverizing apparatuses and two classifying apparatuses. More specifically, the former include a first pulverizing apparatus (first pulverizing means) 31, a second pulverizing apparatus (second pulverizing means) 35, and a third pulverizing apparatus (third pulverizing means) 40. The latter include a first classifying apparatus (first classifying means) 34 and a second classifying apparatus (second classifying means) 39.

The first pulverizing apparatus 31 adopts a mechanical method, while the other second and third pulverizing apparatuses 35 and 40 adopt a jet method. Both the first and second classifying apparatuses adopt a pneumatic classifying method. However, the pulverizing method and classifying method are not limited to the above examples.

The first pulverizing apparatus 31 has an inlet 31*a*, through which the above toner raw material is introduced. The first pulverizing apparatus 31 also has an outlet 31*b*, to which a replenishing apparatus 32 is connected. An outlet 32*a* of the replenishing apparatus 32 is connected to an inlet 34*a* of the first classifying apparatus 34 through a delivering pipe (first delivering member) 33.

The first classifying apparatus 34 has an outlet for coarse powders, which is connected to an unillustrated inlet of the second pulverizing apparatus 35. An air compressor 36 is connected to the second pulverizing apparatus 35 in its right side in the drawing. The air compressor 36 supplies a compressed air to the above unillustrated inlet, so that the material subject to pulverization is introduced into the second pulverizing apparatus 35 rapidly through an unillustrated nozzle. Consequently, the introduced material is pulverized and a pulverized material is obtained.

The second pulverizing apparatus 35 has an outlet 35*b* in its left side in the drawing. The delivering pipe 33 branches into two directions. One is connected to the inlet 34*a* as previously mentioned, and the other is connected to the outlet 35*b*, This arrangement makes it possible to deliver/supply the pulverized material from the second pulverizing apparatus 35 to the first classifying apparatus 34 through the delivering pipe 33.

On the other hand, an outlet 34*b* for the pulverized material of the first classifying apparatus 34 is connected to an inlet 37*a* of a cyclone 37. An outlet 37*b* of the cyclone 37 is connected to a first inlet 39*a* of the second classifying apparatus 39 through a delivering pipe (second delivering member) 38.

An outlet for coarse powders of the second classifying apparatus 39 is connected to an unillustrated inlet of the third pulverizing apparatus 40. An air compressor 41 is connected to the third pulverizing apparatus 40 at its right side in the drawing. The air compressor 41 supplies a compressed air to the above unillustrated inlet, so that the material subject to pulverization is introduced into the third pulverizing apparatus 40 rapidly through an unillustrated nozzle. Consequently, the introduced material is pulverized and the pulverized material is obtained.

The third pulverizing apparatus 40 has an outlet 40*b* in its left side in the drawing, which is connected to a second inlet 39*d* of the second classifying apparatus 39 through a delivering pipe (second delivering member) 42. This arrangement makes it possible to deliver/supply the pulverized material to the second classifying apparatus 39 from the third pulverizing apparatus 40 through the delivering pipe 42.

On the other hand, an outlet 39*b* for pulverized material of the second classifying apparatus 39 is connected to an inlet 43*a* of a cyclone 43. An outlet 43*b* of the cyclone 43 is connected to a replenishing apparatus 45 through a delivering pipe 44. An outlet 45*a* of the replenishing apparatus 45 is connected to an inlet 46*a* of a cyclone 46 through a delivering pipe 49, so that the resulting powders are discharged through an outlet 46*b* of the cyclone 46 as the product, namely, toner.

In addition, the first classifying apparatus 34, cyclone 37, second classifying apparatus 39, and cyclones 43 and 46 have their respective outlets for microscopic powders at the top, which are respectively denoted as 34*c*, 37*c*, 39*c*, 43*c*, and 46*c* in the drawing. All of these outlets for microscopic powders are connected to a microscopic powder cyclone 48 through a microscopic powder delivering pipe 47.

As has been explained, the second classifying apparatus 39 has two inlets for pulverized material: the first and second inlets 39*a* and 39*d*, The former is an opening through which a first classified pulverized material is introduced from the first classifying apparatus 34. The latter is an opening through which a second classified pulverized material is introduced from the third pulverizing apparatus 40. This arrangement can suppress the occurrence of the microscopic powders efficiently.

Also, as previously mentioned, each of the second and third pulverizing apparatuses 35 and 40 introduces the material subject to pulverization into their respective pulverizing chambers rapidly using the air compressors connected to each, so that the material is pulverized by an impact given thereto.

Next, a structure of the pulverizing chamber in each of the second and third pulverizing apparatus 35 and 40 will be explained.

Figure 1:
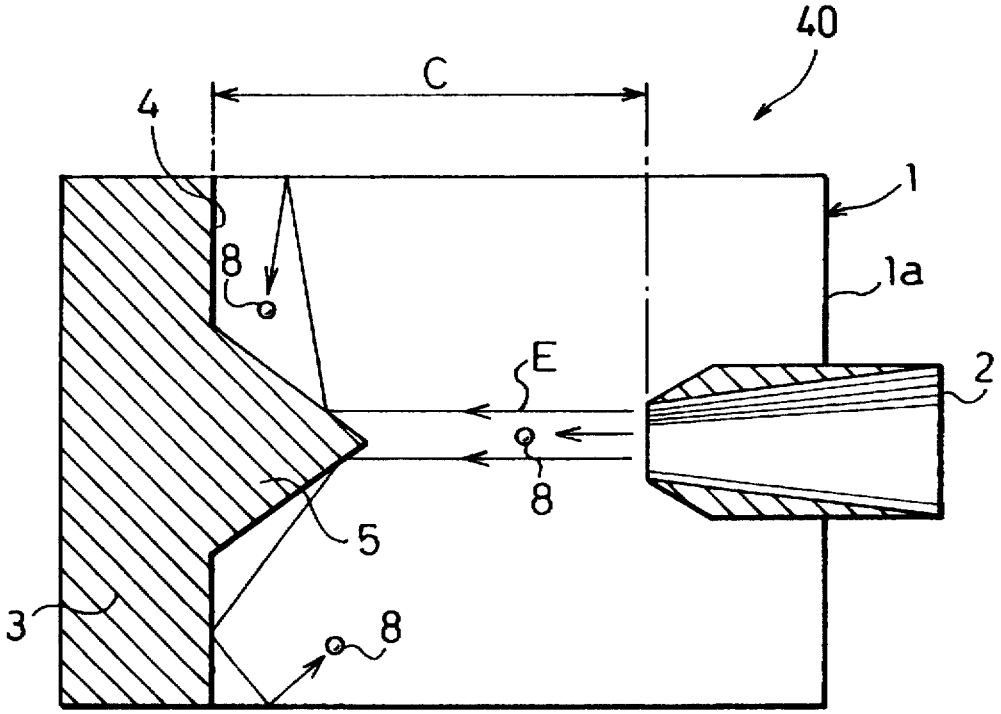
FIG. 1 is a cross section illustrating a third pulverizing chamber in a third pulverizing apparatus in accordance with an example toner producing system of the present invention.

As shown in FIG. 1, a third pulverizing chamber 1 in the third pulverizing apparatus 40 is a cylinder having its two end surfaces in the right and left side in the drawing, respectively. A cylindrical third nozzle 2 is provided at the center of one end surface la in such a manner that the third pulverizing chamber 1 and third nozzle 2 have a common axis. A material 8 subject to pulverization is introduced into the third pulverizing chamber 1 through the third nozzle 2 in a direction indicated by an arrow E in the drawing. A disk of a third colliding plate (third colliding member) 3 having the same diameter as the third pulverizing chamber 1 is provided inside the third pulverizing chamber 1 in a direction perpendicular with respect to the above direction in which the material 8 is introduced.

Figure 2A:
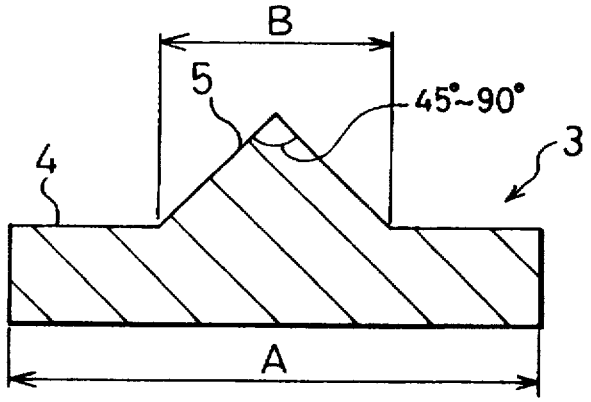
FIGS. 2(*a*) and 2(*b*) are respectively a cross section and a perspective view illustrating a third colliding plate provided in the third pulverizing chamber of FIG. 1.
Figure 2B:
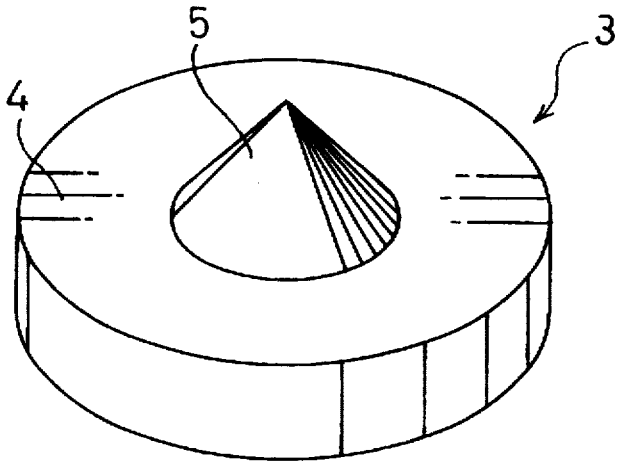

The third colliding plate 3 has a colliding surface 4 that collides with the material 8, and a top of which a cone 5 serving as a conical member is placed at the center in such a manner that end surface la and the cone 5 have a common axis as is shown in FIGS. 1, 2(*a*) and 2(*b*). The bottom surface of the cone 5 has a diameter B, which is ⅓–⅔ of the diameter A of the third colliding plate 3. The angle of the apex of the cone 5 is, for example, in a range between 45° and 90° inclusive. A distance between the third colliding plate 3 and the top end of the third nozzle 2, which is denoted as a capital letter C in FIG. 1, is preferably in a range between 10 mm and 70 mm inclusive. Thus, when arranged in this manner, a major impact force is attained to efficiently pulverize the material 8 to a third pulverized material.

Figure 3:
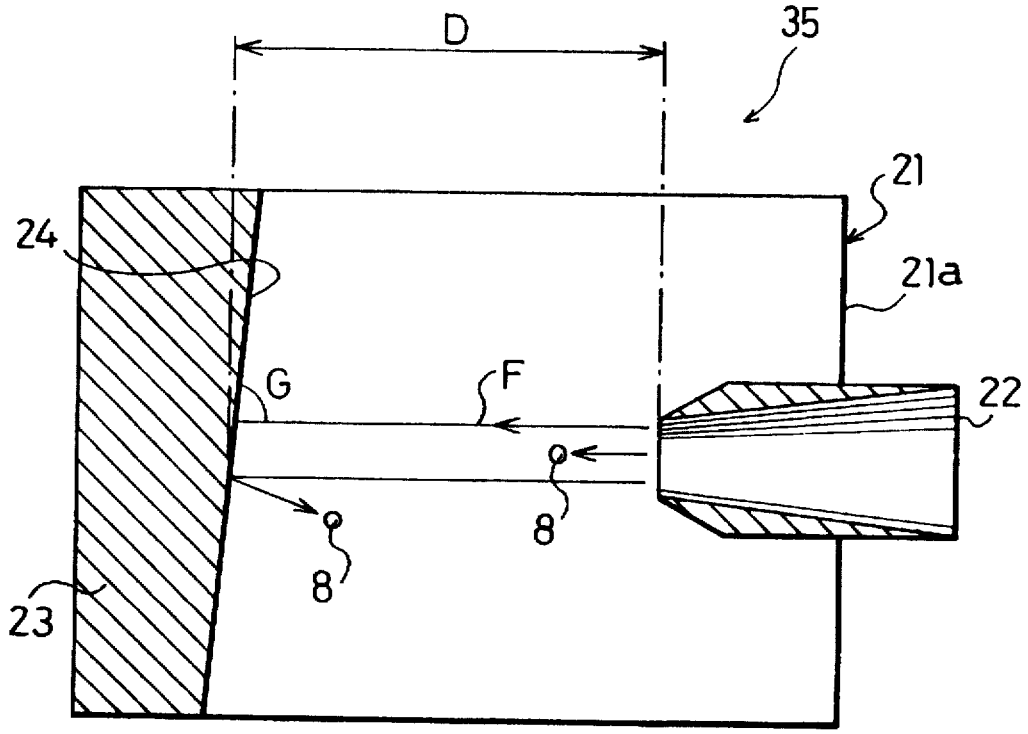
FIG. 3 is a cross section illustrating a second pulverizing chamber of a second pulverizing apparatus provided in the above toner producing system.

As shown in FIG. 3, like the third pulverizing chamber 1, a second pulverizing chamber 21 in the second pulverizing apparatus 35 is a cylinder and has its two end surfaces in the right and left sides in the drawing, respectively. A cylindrical second nozzle 22 is provided at the center of the end surface 21a in such a manner that the second pulverizing chamber 21 and second nozzle 22 have a common axis. The material 8 subject to pulverization is introduced into the second pulverizing chamber 21 through the second nozzle 22 in a direction indicated by an arrow F in the drawing. A disk of a second colliding plate (second colliding member) 23 having the same diameter as the second pulverizing chamber 21 is provided inside the second pulverizing chamber 21 at an angle G with respect to the direction in which the material 8 is introduced. A definition of the angle G will be given in the next paragraph.

The second colliding plate 23 has a colliding surface 24 with which the material 8 collides. The colliding surface 24 is an inclined plane surface at the angle G ranging from 45° to 90° with respect to the direction indicated by the arrow F in which the material 8 is introduced. A distance between the second colliding plate 23 and the top end of the second nozzle 22, which is denoted as a capital letter D in the drawing, is preferably in a range between 70 mm and 120 mm inclusive. When arranged in this manner, overpulverization can be further suppressed.

Next, an overall operation of the above toner producing system will be explained with reference to FIG. 4.

To begin, the toner raw material is introduced into the first pulverizing apparatus 31 through its inlet 31*a*, and pulverized mechanically to a first pulverized material. Then, the first pulverized material is delivered from the outlet 31*b* to the first classifying apparatus 34 by means of the delivering pipe 33 through the replenishing apparatus 32. Accordingly, the first pulverized material is classified into a first classified coarse powders and a first classified pulverized material. The latter is smaller than the former in particle size. The first classified coarse powders are sent to the second pulverizing apparatus 35 placed directly below and is pulverized to a second pulverized material.

The second pulverized material is returned to the first classifying apparatus 34 by means of the delivering pipe 33 and is subject to classification again.

Next, the first classified pulverized material, including the one pulverized from the second pulverized material supplied from the second pulverizing apparatus 35, is delivered to the second classifying apparatus 39 by means of the delivering pipe 38 through the outlet 34*b* and cyclone 37, and pulverized to second classified coarse powders and a second classified pulverized material. The latter is smaller than the former in particle size.

The second coarse powders are sent to the third pulverizing apparatus 40 provided directly below, and pulverized to a third pulverized is material.

The third pulverized material is returned to the second classifying apparatus 39 by means of the delivering pipe 42, and is subject to classification again. The resulting pulverized material has a particle size smaller than the coarse powders and larger than the microscopic powders. The second classified pulverized material is sent to the cyclone 43 through the outlet 39*b* and further to the replenishing apparatus 45 and cyclone 46, and released from the outlet 46*b* as a final product, namely, toner. Note that particles having a size larger than the second classified pulverized material are repetitively sent to the third pulverizing apparatus 40 and subjected to classification by the second classification apparatus 39 until the particle size becomes adequate.

Microscopic powders are produced during the above pulverizing step and super-microscopic powders are produced by further pulverizing the microscopic powders. However, the unwanted microscopic powders and supermicroscopic powders are released from the first classifying apparatus 34, cyclone 37, second classifying apparatus 39, and cyclones 43 and 46 through their respective outlets for microscopic powder 34*c*, 37*c*, 39*c*, 43*c*, and 46*c*, so that they are sucked in and collected by the cyclone 48 for microscopic powder through the microscopic delivering pipe 47.

Next, the pulverizing operation of the second and third pulverizing apparatuses 35 and 40 will be explained.

To begin, as is illustrated in FIG. 3, the material 8 introduced into the second pulverizing chamber 21 through the second nozzle 22 collides with the second colliding plate 23. As previously mentioned, the second colliding plate 23 is inclined at the angle G ranging from 45° to 90° with respect to the direction indicated by the arrow F in which the material 8 is introduced. Thus, upon collision with the second colliding plate 23, the material 8 bounces backward and stops eventually. This arrangement makes it possible to lower the pulverizing impact force to the weakest possible level in the second pulverizing apparatus 35, so that the material 8 collides with the second colliding plate 23 the least number of times. Consequently, the overpulverization, and hence the occurrence of the microscopic powders can be suppressed.

In case of the third pulverizing apparatus 40, as is illustrated in FIG. 1, the material 8 introduced into the third pulverizing chamber 1 through the third nozzle 2 collides with the outer surface of the cone 5 provided on the third colliding plate 3 first, and thence, bounces back to collide with the inner wall of the third pulverizing chamber 1. Subsequently, the material 8 repetitively collides with the third colliding plate 3 or the inner wall of the third pulverizing chamber 1 while maintaining its momentum. Thus, a single pulverizing operation, that is, introducing the material 8 through the third nozzle 2 with an application of an air pressure for pulverization, can cause the material 8 to collide with the third colliding plate 3 or the inner wall of the third colliding chamber 1 a number of times. Thus, the third colliding plate 3 can pulverize a small quantity of the material 8 with a major impact force in a sufficiently manner.

(Embodiment 2)

The following description will describe another example embodiment of the present invention. Hereinafter, like components are labeled with like reference numerals with respect to Embodiment 1, and the description of these components is not repeated for the explanation's convenience.

A toner producing system of the present embodiment is identical with its counterpart of Embodiment 1 except for the third colliding member.

Figure 5:
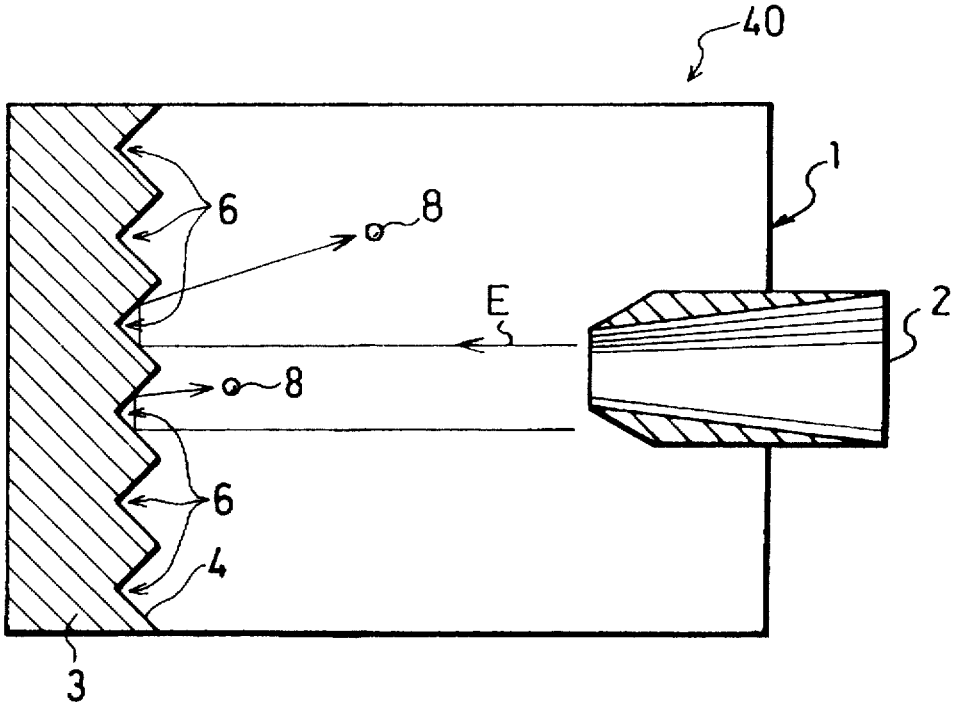
FIG. 5 is a cross section illustrating a third pulverizing chamber in a third pulverizing apparatus in accordance with another example toner producing system of the present invention.

To be more specific, the third colliding plate (third colliding member) 3 is provided inside the third pulverizing apparatus 40 in the same manner as Embodiment 1, but the colliding surface 4 is modified as illustrated in FIG. 5.

Figure 6:
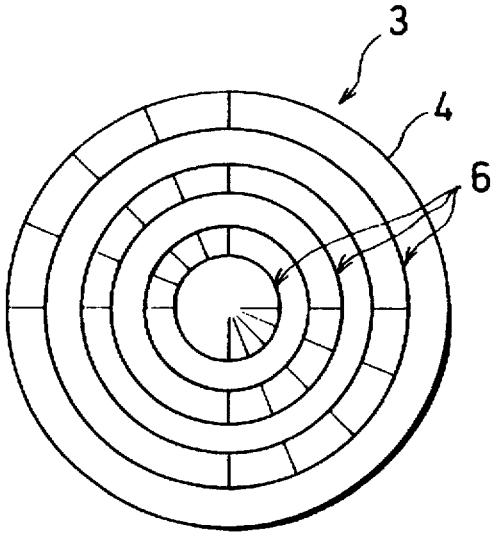
FIG. 6 is a plan view illustrating a third colliding plate provided in the third pulverizing chamber of FIG. 5.

As are illustrated in FIGS. 5 and 6, V-shaped grooves 6 are formed concentrically around the axis of the third pulverizing chamber 1 on the plane surface 4 of the third colliding plate 3.

Arranged in this manner, the material 8 introduced into the third pulverizing chamber 1 through the third nozzle 2 collides with the surface of one of the grooves 6 first, and thence bounces back to repetitively collide with the surface of another groove 6 or the inner wall of the third pulverizing chamber 1 while maintaining the momentum. As a consequence, the present toner producing system can pulverize the material 8 to an adequate particle size.

(Embodiment 3)

The following description will describe a further example embodiment of the present invention.

Hereinafter, like components are labeled with like reference numerals with respect to Embodiments 1 and 2, and the description of these components is not repeated for the explanation's convenience.

A toner producing system of the present embodiment is identical with its counterpart of Embodiment 1 except for the third colliding member.

Figure 7:
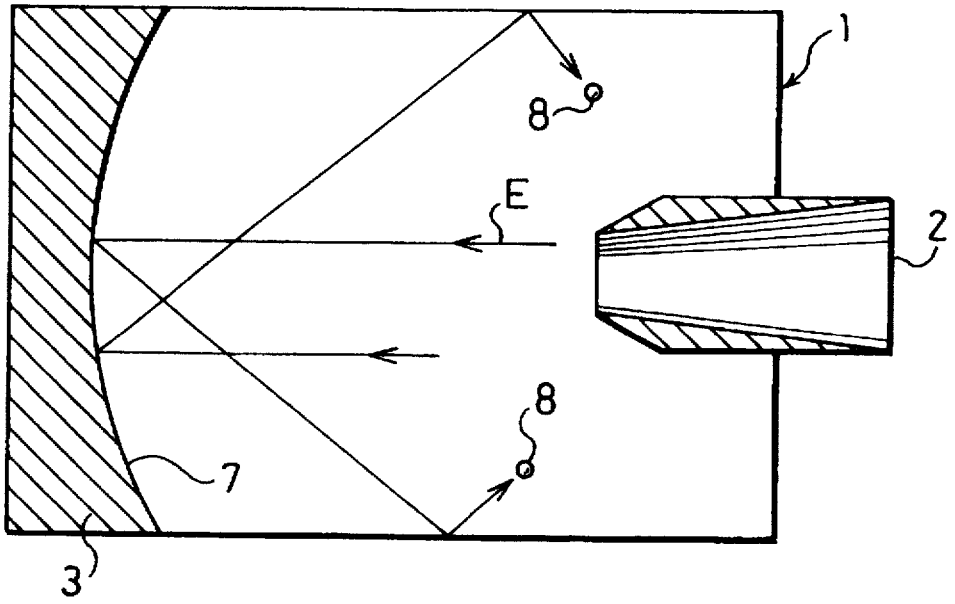
FIG. 7 is a cross section illustrating a third pulverizing chamber of a third pulverizing apparatus in accordance with a further example toner producing system of the present invention.

To be more specific, the third colliding plate (third colliding member) 3 is provided inside the third pulverizing apparatus 40 in the same manner as Embodiment 1, but the colliding surface 4 is replaced with a concave colliding surface 7 as is illustrated in FIG. 7.

Arranged in this manner, the material 8 introduced into the third pulverizing chamber 1 through the third nozzle 2 collides with the concave colliding surface 7 first, and thence bounces back to collide with the inner surface of the third pulverizing chamber 1 rapidly. Subsequently, the material 8 repetitively collides with the concave colliding surface 7 or the inner surface of the third pulverizing chamber 1 while maintaining the momentum. As a consequence, the present toner producing system can pulverize the material 8 to an adequate particle size.

(Embodiment 4)

The following description will describe still another example embodiment of the present invention. Hereinafter, like components are labeled with like reference numerals with respect to Embodiments 1–3, and the description of these components is not repeated for the explanation's convenience.

A toner producing system of the present embodiment can have the structure of any of Embodiments 1–3 except for the second and third nozzles 22 and 2.

Figure 8:
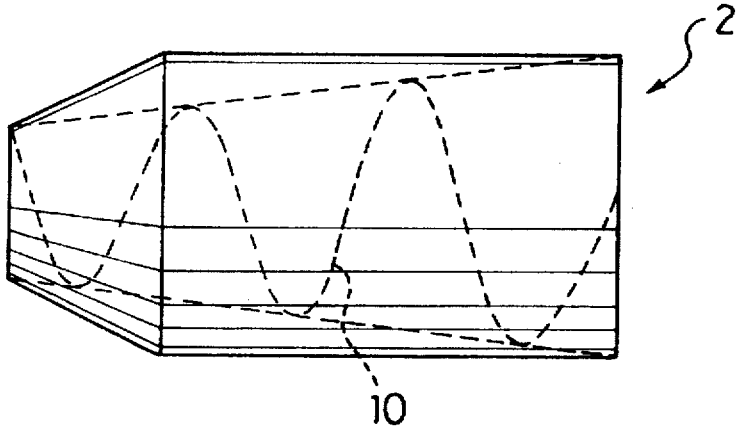
FIGS. 8(*a*) and 8(*b*) are respectively a lateral view and a bottom view illustrating a schematic structure of a third nozzle.
Figure 8:
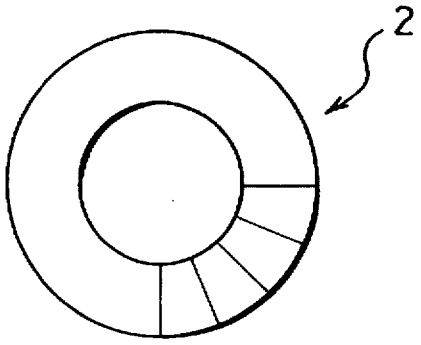

To be more specific, the third nozzle 2 is modified to have a spiral groove 10 on the inner surface along which the material 8 passes through as is illustrated in FIGS. 8(*a*) and 8(*b*). Thus, the material 8 is introduced into the third pulverizing chamber 1 by moving in a spiral along the groove 10. Therefore, the groove 10 has a function to guide the material into the third pulverizing chamber 1. This arrangement makes it possible to steadily supply the material 8 to the colliding plate 3 in a reliable manner while preventing the diffusion.

The second nozzle 22 is modified in the same manner as the third nozzle 2, and the same effects can be attained.

In the following, operations by the example methods and systems of the present invention will be explained with reference to a comparative example.

(Example 1)

The following description will describe an example of the present invention.

A toner producing system of the present example is, as has been explained above, produces toner in the following procedure:

(1) melt-kneading components including a binder resin and a coloring agent to produce a kneaded product;

(2) cooling and solidifying the kneaded product to make a solid toner raw material; and (3) pulverizing and classifying the toner raw material.

A comparative toner is produced by the conventional producing system, which differs from the toner producing system of Embodiment 1 of the present invention in that it omits the second classifying means and the second and third pulverizing means. The toner raw material is pulverized in the following manner.

The toner raw material used herein is a kneaded solid material made of styrene acrylic resin, wax, carbon, and an anti-static agent. The toner raw material is coarsely pulverized to have a particle size larger than 60 μm by a pulverizing apparatus adopting a mechanical method. The pulverizing apparatus used herein is a Model IDS 5 of Nihon Pneumatic Kogyo K. K., having an air pressure for pulverization of 5 kg/cm$^2$. The resulting pulverized material is introduced into a pneumatic classifying apparatus to be classified into the coarse powders and microscopic powders by a wind force. A particle size distribution measuring device of a model TA-2 of Couleter Electronics Inc. is used herein.

The size (diameter) of sieve in each channel is set forth in Table 1 below, and the operation result is set forth in Tables 2 and 3 below. The occurrence (%) of microscopic powders is computed by the following equation:

$$\left(\frac{\text{weight of microscopic powders}}{\text{weight of toner raw material}}\right)\times 100.$$

TABLE 1

| | | | | | | | | |
|---|---|---|---|---|---|---|---|---|
| CHANNEL | 1 | 2 | 3 | 4 | 5 | 6 | 7 | 8 |
| SIEVE (μm) | 1.26 | 1.59 | 2.00 | 2.52 | 3.17 | 4.00 | 5.04 | 6.35 |
| CHANNEL | 9 | 10 | 11 | 12 | 13 | 14 | 15 | 16 |
| SIEVE (μm) | 8.00 | 10.1 | 12.7 | 16.0 | 20.2 | 25.4 | 32.0 | 40.3 |

TABLE 2

| | TOTAL AT BAG FILTER | MICROSCOPIC POWDERS | TOTAL |
|---|---|---|---|
| OCCURRENCE (%) OF MICROSCOPIC POWDERS | 7.0 | 16.3 | 23.3 |

TABLE 3

| | | | | | | | | |
|---|---|---|---|---|---|---|---|---|
| CHANNEL | 1 | 2 | 3 | 4 | 5 | 6 | 7 | 8 |
| PARTICLE SIZE DISTRIBUTION(%) | 0 | 0 | 0 | 0 | 0 | 0.9 | 5.8 | 16.0 |
| CHANNEL | 9 | 10 | 11 | 12 | 13 | 14 | 15 | 16 |
| PARTICLE SIZE DISTRIBUTION(%) | 23.8 | 27.8 | 18.2 | 6.2 | 1.4 | 0 | 0 | 0 |

Further, the toner raw material is pulverized in the same manner as Embodiment 1. Herein, the toner raw material is coarsely pulverized to the first pulverized material having a particle size in a range between 40 μm and 60 μm by the first pulverizing apparatus 31 adopting the mechanical method. Also, the colliding surface 24 of the second colliding plate 23 in the second pulverizing chamber 21 of the second pulverizing apparatus 35 is inclined at 90° with respect to the direction in which the pulverizing air, that is, the material 8, is introduced (indicated by the arrow F in FIG. 3) Further, the third colliding plate 3 in the third pulverizing chamber 1 of the third pulverizing apparatus 40 is made into a disk having an adequate diameter, so that the same fits into the first pulverizing chamber 1 having an inside diameter of 30 mm. Also, the cone 5 on the colliding surface 4 of the third colliding plate 3 has a diameter of 30 mm and an apex angle of 50°. Each of the second and third nozzles 22 and 2 is modified to have the spiral groove 10 on the inner surface as was explained in Embodiment 4. The air pressures for pulverization in the second and third pulverizing chambers 21 and 1 (which are hereinafter referred to as the second and third air pressures for pulverization, respectively) are 2 kg/cm$^2$ and 4 kg/cm$^2$, respectively. The operation result is set forth in Tables 4 and 5 below.

TABLE 4

| | TOTAL AT BAG FILTER | MICROSCOPIC POWDERS | TOTAL |
|---|---|---|---|
| OCCURRENCE (%) OF MICROSCOPIC POWDERS | 2.0 | 13.3 | 15.3 |

TABLE 5

| | | | | | | | | |
|---|---|---|---|---|---|---|---|---|
| CHANNEL | 1 | 2 | 3 | 4 | 5 | 6 | 7 | 8 |
| PARTICLE SIZE DISTRIBUTION(%) | 0 | 0 | 0 | 0 | 0 | 0.5 | 4.2 | 14.8 |
| CHANNEL | 9 | 10 | 11 | 12 | 13 | 14 | 15 | 16 |
| PARTICLE SIZE DISTRIBUTION(%) | 26.1 | 32.1 | 17.7 | 4.2 | 0.4 | 0 | 0 | 0 |

Tables 1–5 above reveal that the toner producing method of the present invention reduces the total occurrence of the microscopic powders by 8.0% and makes the particle size distribution sharper compared with the conventional pulverizing method.

(Example 2)

Herein, the colliding surface 24 of the second colliding plate 23 in the second pulverizing apparatus 35 is inclined at the angle G of 60° with respect to a direction in which the pulverizing air is released (see FIG. 3). Also the cone 5 having a diameter B of 15 mm (see FIG. 1) is provided on the colliding surface 4 having a diameter A of 30 mm of the third colliding plate 3 in the third pulverizing chamber 1 of the third pulverizing apparatus 40. The second and third air pressures for pulverization are 3 kg/cm$^2$ and 8 kg/cm$^2$, respectively. Otherwise, the operation is carried out in the same manner as Embodiment 1 as was detailed in Example 1, and the result of which is set forth in Tables 6 and 7 below.

TABLE 6

| | TOTAL AT BAG FILTER | MICROSCOPIC POWDERS | TOTAL |
|---|---|---|---|
| OCCURRENCE (%) OF MICROSCOPIC POWDERS | 1.7 | 12.7 | 14.4 |

TABLE 7

| | | | | | | | | |
|---|---|---|---|---|---|---|---|---|
| CHANNEL | 1 | 2 | 3 | 4 | 5 | 6 | 7 | 8 |
| PARTICLE SIZE DISTRIBUTION(%) | 0 | 0 | 0 | 0 | 0 | 0.5 | 3.8 | 15.4 |
| CHANNEL | 9 | 10 | 11 | 12 | 13 | 14 | 15 | 16 |
| PARTICLE SIZE DISTRIBUTION(%) | 27.0 | 31.1 | 17.2 | 4.5 | 0.5 | 0 | 0 | 0 |

(Example 3)

The toner raw material is pulverized in the same manner as Example 2 except that the angel G of the second colliding plate 23 and the diameter B of the cone 5 are modified as set forth in Table 8 below, and the operation result is set forth in Tables 8 and 9 below.

TABLE 8

| | | | OCCURRENCE (%) OF MICROSCOPIC POWDERS | | |
|---|---|---|---|---|---|
| No. | ANGLE G (°) | DIA. B (mm) | TOTAL AT BAG FILTER | MICROSCOPIC POWDERS | TOTAL |
| 1 | 45 | 10 | 1.5 | 10.0 | 11.5 |
| 2 | 90 | 10 | 1.5 | 11.1 | 12.6 |
| 3 | 45 | 20 | 2.0 | 9.8 | 11.8 |
| 4 | 90 | 20 | 1.8 | 10.1 | 11.9 |
| 5 | 100 | 30 | 2.5 | 23.2 | 25.7 |
| 6 | 30 | 30 | 3.2 | 27.4 | 30.6 |
| 7 | 100 | 5 | 3.5 | 29.3 | 32.8 |
| 8 | 30 | 5 | 4.8 | 30.5 | 35.3 |

TABLE 9

PARTICLE SIZE DISTRIBUTION (%)

| | CHANNEL | | | | | | | |
|---|---|---|---|---|---|---|---|---|
| No. | 1 | 2 | 3 | 4 | 5 | 6 | 7 | 8 |
| 1 | 0 | 0 | 0 | 0 | 0 | 0.4 | 3.4 | 15.0 |
| 2 | 0 | 0 | 0 | 0 | 0 | 0.3 | 3.4 | 15.2 |
| 3 | 0 | 0 | 0 | 0 | 0 | 0.6 | 3.3 | 15.1 |
| 4 | 0 | 0 | 0 | 0 | 0 | 0.6 | 3.6 | 15.0 |
| 5 | 0 | 0 | 0 | 0 | 0 | 0.9 | 4.5 | 19.0 |
| 6 | 0 | 0 | 0 | 0 | 0 | 0.7 | 4.3 | 18.1 |
| 7 | 0 | 0 | 0 | 0 | 0 | 0.9 | 4.2 | 19.2 |
| 8 | 0 | 0 | 0 | 0 | 0 | 0.2 | 3.9 | 19.2 |

| | CHANNEL | | | | | | | |
|---|---|---|---|---|---|---|---|---|
| No. | 9 | 10 | 11 | 12 | 13 | 14 | 15 | 16 |
| 1 | 27.9 | 31.7 | 16.7 | 4.5 | 0.6 | 0 | 0 | 0 |
| 2 | 30.1 | 31.1 | 17.4 | 4.8 | 0.4 | 0 | 0 | 0 |
| 3 | 27.8 | 32.0 | 16.4 | 4.4 | 0.6 | 0 | 0 | 0 |
| 4 | 27.9 | 31.3 | 16.1 | 4.9 | 0.6 | 0 | 0 | 0 |
| 5 | 26.9 | 27.8 | 16.1 | 4.2 | 0.8 | 0 | 0 | 0 |
| 6 | 27.1 | 28.7 | 16.3 | 4.4 | 0.6 | 0 | 0 | 0 |
| 7 | 26.9 | 28.1 | 16.3 | 4.4 | 0.8 | 0 | 0 | 0 |
| 8 | 27.2 | 28.4 | 15.8 | 5.1 | 0.6 | 0 | 0 | 0 |

Table 6–9 above reveal that limiting the angle G to a range between 45° and 90° inclusive can further suppress the total occurrence of the microscopic powders compared with the conventional pulverizing method. The same also reveal that making the diameter B of the cone 5 to ⅓–⅔ of the diameter A of the colliding surface 4 can suppress the total occurrence of the microscopic powders as well and make the particle size distribution sharper compared with the conventional pulverizing method.

(Example 4)

Herein, 50 kg of the toner raw material is pulverized in the same manner as Embodiment 2 except that the second and third air pressures for pulverization are 3 kg/cm$^2$ and 7 kg/cm$^2$, respectively, and the distance between the second colliding plate 23 and the top end of the second nozzle 22 in the second pulverizing apparatus 35 and the distance between the third colliding plate 3 and the top end of the third nozzle 2 in the third pulverizing apparatus 40 are modified as set forth in Tables 10 and 11 below. The toner raw material is subject to continuous pulverization under these conditions and a pulverizing time is measured. The pulverizing time referred herein means a time necessary to pulverize 50 kg of the toner raw material to toner powders. The operation result is set forth in Tables 10 and 11 below.

TABLE 10

| No. | a(mm) | b(mm) | PULVERIZING TIME (MIN.) |
|---|---|---|---|
| 1 | 60 | 8 | 72 |
| 2 | 60 | 10 | 68 |
| 3 | 60 | 20 | 67 |
| 4 | 60 | 40 | 65 |
| 5 | 60 | 50 | 65 |
| 6 | 60 | 70 | 68 |
| 7 | 60 | 80 | 77 |
| 8 | 70 | 8 | 71 |
| 9 | 70 | 10 | 60 |
| 10 | 70 | 20 | 60 |
| 11 | 70 | 40 | 58 |
| 12 | 70 | 50 | 58 |
| 13 | 70 | 70 | 59 |
| 14 | 70 | 80 | 70 |
| 15 | 90 | 8 | 61 |
| 16 | 90 | 10 | 55 |
| 17 | 90 | 20 | 53 |
| 18 | 90 | 40 | 52 |
| 19 | 90 | 50 | 52 |
| 20 | 90 | 70 | 55 |
| 21 | 90 | 80 | 64 |

a: Colliding Plate - Nozzle Distance in Second Pulverizing Apparatus
b: Colliding Plate - Nozzle Distance in Third Pulverizing Apparatus

TABLE 11

| No. | a(mm) | b(mm) | PULVERIZING TIME (MIN.) |
|---|---|---|---|
| 22 | 120 | 8 | 72 |
| 23 | 120 | 10 | 59 |
| 24 | 120 | 20 | 59 |
| 25 | 120 | 40 | 58 |
| 26 | 120 | 50 | 57 |
| 27 | 120 | 70 | 60 |
| 28 | 120 | 80 | 69 |
| 29 | 130 | 8 | 70 |
| 30 | 130 | 10 | 75 |
| 31 | 130 | 20 | 73 |
| 32 | 130 | 40 | 67 |
| 33 | 130 | 50 | 69 |
| 34 | 130 | 70 | 77 |
| 35 | 130 | 80 | 79 |

a: Colliding Plate - Nozzle Distance in Second Pulverizing Apparatus
b: Colliding Plate - Nozzle Distance in Third Pulverizing Apparatus Of all the above Operations 1–35, Operations 1 and 35 show the poorest results, while Operations 9, 17, 18, 26, and 27 show excellent results, which are set forth in Table 12 and 13 below.

TABLE 12

| | OCCURRENCE (%) OF MICROSCOPIC POWDERS | | |
|---|---|---|---|
| No. | TOTAL AT BAG FILTER | MICROSCOPIC POWDERS | TOTAL |
| 1 | 8.7 | 35.6 | 44.3 |
| 9 | 2.0 | 10.1 | 12.1 |
| 17 | 1.7 | 10.5 | 12.2 |
| 18 | 1.8 | 12.2 | 14.0 |
| 26 | 1.8 | 12.1 | 13.9 |
| 27 | 1.7 | 11.3 | 13.0 |
| 35 | 7.2 | 15.6 | 22.8 |

TABLE 13

| | PARTICLE SIZE DISTRIBUTION (%) | | | | | | | |
|---|---|---|---|---|---|---|---|---|
| | CHANNEL | | | | | | | |
| No. | 1 | 2 | 3 | 4 | 5 | 6 | 7 | 8 |
| 1 | 0 | 0 | 0 | 0 | 0 | 1.0 | 6.7 | 20.1 |
| 9 | 0 | 0 | 0 | 0 | 0 | 0.4 | 3.5 | 15.2 |
| 17 | 0 | 0 | 0 | 0 | 0 | 0.3 | 3.3 | 15.1 |
| 18 | 0 | 0 | 0 | 0 | 0 | 0.4 | 5.4 | 15.7 |
| 26 | 0 | 0 | 0 | 0 | 0 | 0.4 | 3.5 | 16.0 |
| 27 | 0 | 0 | 0 | 0 | 0 | 0.5 | 3.3 | 15.0 |
| 35 | 0 | 0 | 0 | 0 | 0 | 1.3 | 8.7 | 21.1 |
| | CHANNEL | | | | | | | |
| No. | 9 | 10 | 11 | 12 | 13 | 14 | 15 | 16 |
| 1 | 25.7 | 27.3 | 15.1 | 3.5 | 0.6 | 0 | 0 | 0 |
| 9 | 29.7 | 32.0 | 17.0 | 3.0 | 0.2 | 0 | 0 | 0 |
| 17 | 29.5 | 32.5 | 16.3 | 2.5 | 0.5 | 0 | 0 | 0 |
| 18 | 26.1 | 30.5 | 15.8 | 4.1 | 0.5 | 0 | 0 | 0 |
| 26 | 29.0 | 31.3 | 15.1 | 4.1 | 0.6 | 0 | 0 | 0 |
| 27 | 29.3 | 31.9 | 15.5 | 4.1 | 0.4 | 0 | 0 | 0 |
| 35 | 25.3 | 26.1 | 14.3 | 3.0 | 0.2 | 0 | 0 | 0 |

Table 10–13 reveal that, in Operations 1–7, the pulverization is not efficient because the toner raw material is overpulverized with the occurrence of the microscopic powders exceeding 25% and the pulverization take as as 60 minutes. A short distance between the second colliding plate 23 and second nozzle 22 is presumably responsible for the poor result. On the other hand, Operations 9–13, 16–20, and 23–27, the toner raw material is pulverized at relatively good energy efficiency with a short pulverizing time. Therefore, the colliding plate-nozzle distances in both the second and third pulverizing apparatuses 35 and 40 are presumably adequate. In Operations 29–35, although the occurrence of microscopic powders is relatively low, a long pulverizing time lowers the energy efficiency in pulverization.

(Example 5)

Used as the second and third nozzles 22 and 2 herein are a cylinder (dia.: 30 mm, inside dia.: 20 mm, length: 15 mm) made of alumina ceramic, to which the spiral groove 10 (see FIG. 8) having a radius of 2 mm is provided on its inner surface at a pitch of 4 mm. Here, 50 kg of the toner raw material obtained in Example 1 is pulverized under the same conditions as Operation 5 in Example 4 in 53 minutes, and the result of which is set forth in Tables 14 and 15 below.

TABLE 14

| | TOTAL AT BAG FILTER | MICROSCOPIC POWDERS | TOTAL |
|---|---|---|---|
| OCCURRENCE (%) OF MICROSCOPIC POWDERS | 1.2 | 8.5 | 9.7 |

TABLE 15

| CHANNEL | 1 | 2 | 3 | 4 | 5 | 6 | 7 | 8 |
|---|---|---|---|---|---|---|---|---|
| PARTICLE SIZE DISTRIBUTION(%) | 0 | 0 | 0 | 0 | 0 | 0.5 | 3.8 | 15.4 |

TABLE 15-continued

| CHANNEL | 9 | 10 | 11 | 12 | 13 | 14 | 15 | 16 |
|---|---|---|---|---|---|---|---|---|
| PARTICLE SIZE DISTRIBUTION(%) | 27.0 | 31.1 | 17.2 | 4.5 | 0.5 | 0 | 0 | 0 |

Tables 14 and 15 above reveal that providing the spiral groove 10 to the inner surface of each of the second and third nozzles 22 and 2 makes it possible to supply the material 8 respectively to the second and third pulverizing chambers 21 and 1 without causing diffusion. Thus, the occurrence of the microscopic powders can be suppressed compared with Operation 5 above, and the raw material is pulverized more efficiently.

(Examples 6–14)

The above toner raw material is coarsely pulverized to the first pulverized material having a central particle size of 50 μm by the first pulverizing apparatus 31. The cone 5 on the third colliding plate 3 in the third pulverizing chamber 1 (inside dia.: 30 mm) in the third pulverizing apparatus 40 has a diameter of 30 mm and an apex angle of 50°. Both the second and third nozzles 22 and 2 have the spiral grooves 10 on their respective inner surfaces. The colliding plate—nozzle distances are 100 mm and 50 mm in the second and third pulverizing chambers 21 and 1, respectively. The second and third air pressures for pulverization are modified as set forth in Table 16 below. The occurrence of the microscopic powders is evaluated under these conditions, and the result of which is set forth in Table 17 below. The pulverizing time referred in Table 17 means a time necessary to pulverize 50 kg of the toner raw material completely. Also, the particle size distribution is set forth in Table 18 below.

TABLE 16

| No. | 6 | 7 | 8 | 9 | 10 | 11 | 12 | 13 | 14 |
|---|---|---|---|---|---|---|---|---|---|
| 2ND AIR PRESSURE FOR PULVERIZATION (kg/cm²) | 1 | 1 | 5 | 5 | 3 | 3 | 1 | 5 | 3 |
| 3RD AIR PRESSURE FOR PULVERIZATION (kg/cm²) | 3 | 9 | 3 | 9 | 2 | 9 | 6 | 6 | 5 |

TABLE 17

| | OCCURRENCE (%) OF MICROSCOPIC POWDERS | | | |
|---|---|---|---|---|
| No. | TOTAL AT BAG FILTER | MICROSCOPIC POWDERS | TOTAL | PULVERIZING TIME (MIN) |
| 6 | 2.0 | 10.3 | 12.3 | 75 |
| 7 | 2.5 | 11.1 | 13.6 | 65 |
| 8 | 3.5 | 17.3 | 20.8 | 57 |
| 9 | 2.5 | 14.2 | 16.7 | 50 |
| 10 | 2.7 | 13.9 | 16.5 | 67 |
| 11 | 3.6 | 14.0 | 17.6 | 52 |
| 12 | 3.1 | 11.9 | 15.0 | 70 |
| 13 | 3.3 | 12.1 | 15.4 | 54 |
| 14 | 1.2 | 9.7 | 10.9 | 55 |

TABLE 18

| PARTICLE SIZE DISTRIBUTION (%) | | | | | | | | |
|---|---|---|---|---|---|---|---|---|
| | CHANNEL | | | | | | | |
| No. | 1 | 2 | 3 | 4 | 5 | 6 | 7 | 8 |
| 6 | 0 | 0 | 0 | 0 | 0 | 0.5 | 3.6 | 14.5 |
| 7 | 0 | 0 | 0 | 0 | 0 | 0.7 | 4.2 | 15.9 |
| 8 | 0 | 0 | 0 | 0 | 0 | 1.2 | 5.0 | 15.8 |
| 9 | 0 | 0 | 0 | 0 | 0 | 0.8 | 4.8 | 16.2 |
| 10 | 0 | 0 | 0 | 0 | 0 | 0.6 | 4.6 | 15.8 |
| 11 | 0 | 0 | 0 | 0 | 0 | 0.8 | 4.6 | 16.3 |
| 12 | 0 | 0 | 0 | 0 | 0 | 0.4 | 3.5 | 15.5 |
| 13 | 0 | 0 | 0 | 0 | 0 | 0.5 | 3.7 | 15.8 |
| 14 | 0 | 0 | 0 | 0 | 0 | 0.4 | 3.3 | 16.3 |
| | CHANNEL | | | | | | | |
| No. | 9 | 10 | 11 | 12 | 13 | 14 | 15 | 16 |
| 6 | 27.6 | 29.7 | 18.0 | 5.5 | 0.6 | 0 | 0 | 0 |
| 7 | 27.3 | 29.5 | 16.5 | 4.8 | 0.5 | 0 | 0 | 0 |
| 8 | 27.8 | 28.5 | 16.0 | 5.2 | 0.4 | 0 | 0 | 0 |
| 9 | 26.7 | 28.3 | 17.2 | 4.6 | 0.6 | 0 | 0 | 0 |
| 10 | 27.2 | 28.9 | 17.2 | 5.0 | 0.5 | 0 | 0 | 0 |
| 11 | 27.5 | 28.5 | 17.0 | 4.5 | 0.5 | 0 | 0 | 0 |
| 12 | 27.3 | 29.0 | 18.5 | 4.6 | 0.5 | 0 | 0 | 0 |
| 13 | 27.5 | 28.8 | 18.5 | 4.5 | 0.3 | 0 | 0 | 0 |
| 14 | 26.3 | 31.2 | 17.8 | 4.3 | 0.3 | 0 | 0 | 0 |

The above results reveal that the present toner producing system can pulverize the raw material efficiently while suppressing the occurrence of the microscopic powders when the same is arranged to pulverize the first classified coarse powders by means of the second pulverizing apparatus 35 at an air pressure for pulverization ranging from 2–4 kg/cm² followed by the pulverization by means of the third pulverizing apparatus 40 at an air pressure for pulverization ranging from 4–8 kg/cm², whereas the pulverization out of the above specified ranges not only increases the occurrence of the microscopic powders, but also extends the pulverizing time.

(Comparative Example)

The operation is carried out in the same manner as Example 5 except that one of the two inlets for the first classed pulverized material of the second classifying apparatus 39 is omitted, in other words, it is arranged that no third pulverized material is returned to the second classifying apparatus 39 from the third pulverizing apparatus 40.

The rustling pulverized material, namely, toner, has the same particle size distribution as that of the toner produced in Example 5. However, the occurrence of the microscopic powders is increased by 7.5% to 17.2%, and the pulverizing time is extended to 68 minutes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system of producing toner by pulverizing a solid toner raw material and classifying a resulting pulverized material, said system comprising:

first pulverizing means for coarsely pulverizing said toner raw material to a first pulverized material;

first classifying means for classifying said first pulverized material into a first classified coarse powder and a first classified pulverized material, said first classified pulverized material having a smaller particle size than said first classified coarse powder;

second pulverizing means for introducing said first classified coarse powder to a second pulverizing chamber through a second nozzle, and pulverizing said first classified coarse powder to a second pulverized material by making said first classified coarse powder collide with a second pulverizing means colliding member provided in said second pulverizing chamber:

a first delivering member for delivering said first pulverized material from said first pulverizing means to said first classifying means, and for delivering said second pulverized material back to said first classifying means from said second pulverizing means;

second classifying means for classifying said first classified pulverized material into a second classified coarse powder and a second classified pulverized material, said second classified pulverized material having a smaller particle size than said second classified coarse powder;

third pulverizing means for introducing said second classified coarse powder to a third pulverizing chamber through a third nozzle, and pulverizing said second classified coarse powder to a third pulverized material by making said second classified coarse powder collide with a third pulverizing means colliding member provided in said third pulverizing chamber; and a second delivering member for delivering said first classified pulverized material and said third pulverized material to said second classifying means, wherein, said second pulverizing means colliding member includes a second pulverizing means colliding plate, said second pulverizing means colliding plate having a colliding surface inclined at an angle in a range between 45° and 90° inclusive with respect to a direction in which said first classified coarse powder is introduced into said second pulverizing chamber, said third pulverizing means colliding member has a shape such that it makes said second classified coarse powder collide with an inner surface of said third pulverizing chamber following collision with said third Pulverizing means colliding member; and said second pulverizing means colliding member is structured and arranged so that the first classified coarse powder does not collide substantially with an inner surface of the second pulverizing chamber following collision with the second colliding plate.

2. The system of producing toner as defined in claim 1, wherein said third pulverizing chamber is made of a cylindrical member and has said third nozzle at a center of either end surface and said third pulverizing means colliding member at the other end surface, said third pulverizing means colliding member having a conical member at a center portion of a colliding surface thereof, an apex of said conical member being positioned on an axis of said third nozzle.

3. The system of producing toner as defined in claim 2, wherein said conical member has a diameter in a range between ⅓ and ⅔ of a diameter of said colliding surface of said third pulverizing means colliding member.

4. The system of producing toner as defined in claim 1, wherein said third pulverizing chamber is made of a cylindrical member and has said third pulverizing means nozzle at a center of either end surface and said third pulverizing means colliding member at the other end surface, said third pulverizing means colliding member being a plane panel having a colliding surface, on which V-shaped grooves are provided concentrically around an axis of said third nozzle.

5. The system of producing toner as defined in claim 1, wherein said third pulverizing chamber is made of a cylindrical member and has said third pulverizing means nozzle at a center of either end surface and said third pulverizing means colliding member at the other end surface, said third colliding member being a panel having a smooth concave colliding surface.

6. The system of producing toner as defined in claim 1, wherein said second nozzle has a spiral groove on an inner surface thereof, along which said first classified coarse powder passes through.

7. The system of producing toner as defined in claim 1, wherein said third nozzle has a spiral groove on an inner surface thereof, along which said second classified coarse powder passes through.

8. The system of producing toner as defined in claim 1, wherein a distance between said second colliding plate and a top end of said second nozzle is limited to a range between 70 mm and 120 mm inclusive arid a distance between said third colliding plate and a top end of said third nozzle is limited to a range between 10 mm and 70 mm inclusive.

9. The system of producing toner as defined in claim 1, wherein:

said first pulverizing means pulverizes said toner raw material into said first pulverized material having a particle size in a range between 40 μm and 60 μm;

wherein said second pulverizing means further comprises means for providing air pressure in the range of from about 2 kg/cm$^2$ to about 4 kg/cm$^2$ for pulverizing said first classified coarse powder; and wherein said third pulverizing means further comprises means for providing air pressure in the range of from about 4 kg/cm$^2$ to about 8 kg/cm$^2$ for pulverizing said second classified coarse powder.

10. A method of producing a toner by pulverizing a solid toner raw material and classifying a resulting pulverized material, said method comprising:

a first step of pulverizing said solid toner raw material to a first pulverized material;

a second step of classifying said first pulverized material into a first classified coarse powder and a first classified pulverized material, said first classified pulverized material having a smaller particle size than said first coarse powder;

a third step of pulverizing said first classified coarse powder to a second pulverized material by giving a first impact force;

a fourth step of classifying a mixture of said first and second pulverized materials into said first classified coarse powder and a first classified pulverized material;

a fifth step of classifying said first classified pulverized material into a second classified coarse powder and a second classified pulverized material, said second classified pulverized material having a smaller particle size than said second coarse powder;

a sixth step of pulverizing said second classified coarse powder to a third pulverizing material by giving a second impact force, said second impact force being stronger than said first impact force; and a seventh step of classifying a mixture of said first classified pulverized material and third pulverized material into said second classified coarse powder and second classified pulverized material.

11. The method of producing toner as defined in claim 10, wherein:

said toner raw material is pulverized to said first pulverized material having a particle size in a range between 40 μm and 60 μm in said first step;

said first classified coarse powder is pulverized at an air pressure for pulverization in a range between 2 $kg/cm^2$ and 4 $kg/cm^2$ in said third step; and said second classified coarse powder is pulverized at an air pressure for pulverization in a range between 4 $kg/cm^2$ and 8 $kg/cm^2$ in said sixth step.

* * * * *